US008936337B2

(12) United States Patent
Wada et al.

(10) Patent No.: US 8,936,337 B2
(45) Date of Patent: Jan. 20, 2015

(54) METHOD OF ADDING GLOSS CONTROL TABLE

(71) Applicant: Seiko Epson Corporation, Tokyo (JP)

(72) Inventors: Hiroshi Wada, Azumino (JP); Toru Takahashi, Azumino (JP); Takamitsu Kondo, Azumino (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,259

(22) Filed: Mar. 19, 2014

(65) Prior Publication Data

US 2014/0285558 A1 Sep. 25, 2014

(30) Foreign Application Priority Data

Mar. 22, 2013 (JP) ..... 2013-059562

(51) Int. Cl.
*B41J 29/393* (2006.01)
*B41J 11/00* (2006.01)

(52) U.S. Cl.
CPC ..... *B41J 11/0015* (2013.01)
USPC ..... 347/14; 347/105

(58) Field of Classification Search
CPC ..... G03G 2215/00805; G03G 2215/0081; B41M 5/41; B41J 29/393
USPC ..... 347/14, 16, 19, 105, 101; 399/15, 45, 399/53
See application file for complete search history.

(56) References Cited

U.S. PATENT DOCUMENTS

| | | | | |
|---|---|---|---|---|
| 7,682,015 | B2 * | 3/2010 | Hoshino | 347/102 |
| 8,554,092 | B2 * | 10/2013 | Tanaka | 399/45 |
| 2009/0205684 | A1 | 8/2009 | Orii et al. | |
| 2011/0242556 | A1 | 10/2011 | Jinno et al. | |
| 2012/0293593 | A1 | 11/2012 | Kondo et al. | |
| 2012/0313992 | A1 | 12/2012 | Wada et al. | |

FOREIGN PATENT DOCUMENTS

| | | |
|---|---|---|
| JP | 2000-158793 | 6/2000 |
| JP | 2008-246718 | 10/2008 |
| JP | 2009-218563 | 9/2009 |
| JP | 2011-218563 | 11/2011 |
| JP | 2012-240277 | 12/2012 |
| JP | 2012-254612 | 12/2012 |
| JP | 2012-254613 | 12/2012 |
| JP | 2013-028024 | 2/2013 |
| JP | 2013-028025 | 2/2013 |

* cited by examiner

*Primary Examiner* — Thinh Nguyen
(74) *Attorney, Agent, or Firm* — Workman Nydegger

(57) ABSTRACT

In a method of adding a gloss control table, first base material information formed from a first gloss control table of a first base material and a first pattern measurement value of a test pattern formed on the first base material, and second base material information formed from a second gloss control table of a second base material and a second pattern measurement value of a test pattern formed on the second base material, are stored in the storage unit. The method includes: measuring a pattern of new base material for measuring the test pattern formed using a predetermined amount of ink of a new recording medium, and interpolating the gloss control tables for obtaining a new gloss control table of the new base material using a predetermined measured value interpolation method based on the first base material information and the second base material information.

3 Claims, 13 Drawing Sheets

METHOD OF ADDING GLOSS CONTROL TABLE

BACKGROUND

1. Technical Field

The present invention relates to a method of adding a gloss control table for printing an image having a desired glossiness.

2. Related Art

A printing apparatus in which a liquid such as an ink is discharged and printing of an image is performed by a liquid drop (dot) landing on the recording medium, is known. As the printing apparatus, for example, there is an ink jet printer in which a photo-curable ink (for example, a UV ink) is cured by irradiating a light such as an ultraviolet ray (UV) and is discharged. A method is widely known, in which the UV ink is discharged from a nozzle on the recording medium using such ink jet printer, the UV ink dot formed on the recording medium is cured by the irradiated light, and then the UV ink on the recording medium is fixed. (For example, JP-A-2000-158793).

In the method in JP-A-2000-158793, by curing the UV ink dot discharged on the recording medium by the light, an occurrence of bleeds (blur) on the UV ink dots can be suppressed, and it becomes easy to form good quality image.

However, in the image printed by the ink jet printer using the UV ink, there is a problem of unevenness in glossiness occurring. A difference in the amount of ink discharged (also called DUTY) on the recording medium per unit area is considered as one of the reasons for the unevenness in glossiness occurring. That is, there is a difference in glossiness between a portion where the gradation value of the printed image is high and a portion where the gradation value of the printed image is low, and the difference in glossiness becomes uneven. For example, when printing an image of a person's face, at a part such as skin where the gradation value is low and the amount of ink is small (low DUTY), then the glossiness is low. Contrarily, at a part such as a pupil where the gradation value is high and the amount of ink is large (high DUTY), then the glossiness is high. As a result, the unevenness in glossiness occurs depending on the face part, and thus, it is difficult to form good quality image.

As a printing method for improving the unevenness in glossiness described above, for example, in JP-A-2009-218563, a technology is known, in which a desired glossiness of the image can be obtained by adjusting the DUTY of the color ink and the DUTY of the clear ink. In the printing method in JP-A-2009-218563, a gloss control table that defines a relationship between the DUTY of the color ink and the DUTY of the clear ink required for obtaining a predetermined glossiness is created by an experiment in advance, and then, from the gloss control table and the DUTY of the color ink defined by the image data, the required DUTY of the clear ink is obtained.

However, since the relationship between the DUTY of the color ink and the DUTY of the clear ink in the gloss control table varies by the change of the material of the recording medium, as many gloss control tables as the number of types of the corresponding recording media has been needed. That is, in the printing method in JP-A-2009-218563, the printing apparatus (ink jet printer) has to keep as many gloss control tables as the number of various recording media for printing the image in advance. Therefore, to perform the gloss control of the image in printing with respect to the recording medium of which the gloss control table is not kept in the printing apparatus, it has been required to perform a number of test printings or measuring of the test patterns by using the color ink or the clear ink with respect to the base materials of the new recording media, and then obtain gloss control tables corresponding to the new base materials, to store in the printing apparatus.

SUMMARY

The invention can be realized in the following forms or application examples.

Application Example 1

According to an aspect of the invention, there is provided a method of adding a gloss control table in which the gloss control table with respect to a new base material is added using a printing apparatus. The printing apparatus includes: a first discharge head that discharges a color ink; a second discharge head that discharges a clear ink; a storage unit that stores the gloss control table which defines a relationship between a color DUTY which is an amount of the color ink discharged per unit area of an image forming surface of a recording medium, a clear DUTY which is an amount of the clear ink discharged per unit area, and a glossiness of an image formed by the color ink and the clear ink discharged per unit area; and a control unit. The printing apparatus determines the clear DUTY in the unit area according to the color DUTY in the unit area of the image based on the gloss control table such that the glossiness of the formed image becomes a predetermined value. In the storage unit, first base material information formed from a first base material which is a base material of a first recording medium, first gloss control table which is the gloss control table with respect to the first base material, and a first pattern measured value which is a pattern measured value obtained from printing a test pattern using a predetermined amount of predetermined ink with respect to the first base material and then measuring the test pattern, and second base material information formed from a second base material which is a base material of a second recording medium, second gloss control table which is the gloss control table of the second base material, and a second pattern measured value which is a pattern measured value obtained from printing the test pattern using a predetermined amount of predetermined ink of the second base material and measuring the test pattern, are stored. The method of adding a gloss control table includes: measuring the pattern of new base material for printing the test pattern using the predetermined amount of the predetermined ink with respect to a new base material of a new recording medium on which the image is printed and for measuring the test pattern to measure the pattern measured value; inputting the pattern measured value of the new base material to the printing apparatus; interpolating the gloss control tables for obtaining a new gloss control table that is the gloss control table with respect to the new base material using a predetermined measured value interpolation method based on the first base material information and the second base material information in the control unit; and storing the new gloss control table for storing the new gloss control table obtained in interpolating of the gloss control tables in the storage unit in associated with the new base material.

According to the application example, when performing the gloss control to adjust the desired glossiness of the image formed on the base material (new base material) on the new recording medium, the adjusting is possible from creating the new gloss control table with respect to the new recording medium using the relationship between the first gloss control table and the second gloss control table previously registered in the printing apparatus. Specifically, the gloss control table defines the clear DUTY that produces the desired glossiness with respect to the color DUTY, the first and second pattern measured values that are the measured values of the pattern shape such as a line width of the first test pattern and the second test pattern that are test patterns formed by discharging a predetermined amount of predetermined ink with respect to the first base material (the first recording medium) and the second base material (the second recording medium), are recorded in each of the registered first and second gloss control tables together with each gloss control table of the first base material and the second base material. In a case of using a new recording medium on which the image is to be formed, a new pattern measured value of a new base material which is a measured value (for example, line width) of the shape of the test pattern formed by discharging a predetermined amount of predetermined ink on the base material (new base material) of the new recording medium, is obtained. Based on the base material information of the registered gloss control table (the first and second gloss control tables) having the pattern measured value close to the pattern measured value of the new base material, a new gloss control table corresponding to the new base material can be created from a predetermined method of measured value interpolation. (Moreover, in a case where the number of registered gloss control tables is plural, two gloss control tables having the pattern measured value close to the pattern measured value of the new base material are used.)

Therefore, it is possible to obtain the required gloss control table for the necessary gloss control to the image formed with respect to the new recording medium by mere one test printing and measuring of test pattern without performing a large number of test printing or measuring of test pattern using the color ink and the clear ink with respect to the base material (new base material) of the new recording medium as in the related art.

In addition, by storing the new gloss control table which is obtained by the method of adding the gloss control table in this application example in the storage unit, the new base material information that includes the stored new gloss control table is additionally registered as the known base material information. Accordingly, when generating a gloss control table with respect to the new base material on which a new image is printed from now on, it is possible to contribute to the creating of a gloss control table with a high accuracy.

Application Example 2

According to another aspect of the invention described above, there is provided the method of adding a gloss control table including the steps of: first test printing for printing a test image using the new gloss control table; comparing the pattern measured value for comparing the first pattern measured value, the second pattern measured value, and the pattern measured value of the new base material after the interpolating of the new gloss control table, and for obtaining the pattern measured value closer to the pattern measured value of the new base material among the first pattern measured value and the second pattern measured value; second test printing for printing the test image using the gloss control table stored in the storage in associated with the pattern measured value which is closer to the pattern measured value of the new base material obtained in the comparing of the pattern measured value; and comparing test image for comparing the first test image that is the test image obtained in the first test printing and the second test image that is the test image obtained in the second test printing with respect to an image quality including a desired glossiness. In a case where the second test image is determined to be excellent in the step of comparing the test image, the gloss control table used in the step of printing the second test image is stored in the storage unit in associated with the new base material, instead of the gloss control table of the new base material in the storing of the gloss control table.

According to the application example, with less number of test printing process than the processes in the related art, it is possible to generate the gloss control table by which the image closer to the desired glossiness can be stored related to the new base material, and to use the method of image printing on the new base material (recording medium). Therefore, it is possible to effectively form the image with high quality adjusted to the desired glossiness.

Application Example 3

According to still another aspect of the invention, there is provided the method of adding the gloss control table in which the color ink and the clear ink are the photo-curable ink that are cured by irradiation of light.

In a case where the image is printed using a printing apparatus in which the light irradiation unit is disposed in the vicinity of the discharge head, for example, the photo-curable ink can cure the ink landed on the recording medium without excessive wet-spreading or permeation. Therefore, in the invention, the gloss control is performed by the clear ink to the image formed by the color ink such that the desired glossiness is obtained. Thus, a significant effect of enabling the adjustment of the sophisticated glossiness can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiment of the invention will be described with reference to the drawings. Here, in each drawing below, the scale of each layer and member are made different from the actual scale to make size of each layer and member recognizable.

Overview

Glossiness of Image

First, glossiness of a printed image will be described. The glossiness of the image depends on the state of a reflected light from a recording medium of an external light. For example, if the reflected light is in a scattering state, the glossiness is low and is a so-called "matte tone". Contrarily, if the reflection is close to a regular reflection, a high glossiness is obtained and is a so-called "gloss tone". Then, as described above, unevenness in glossiness of the printed image occurs in an ink jet printer which uses a photo-curable ink. Schematically, the glossiness depends on an amount of ink discharged per unit area on the recording medium, that is, depends on a launched amount of the ink liquid drop. In the specification, the amount of ink discharged per unit area is called "ink DUTY".

Figure 1A:
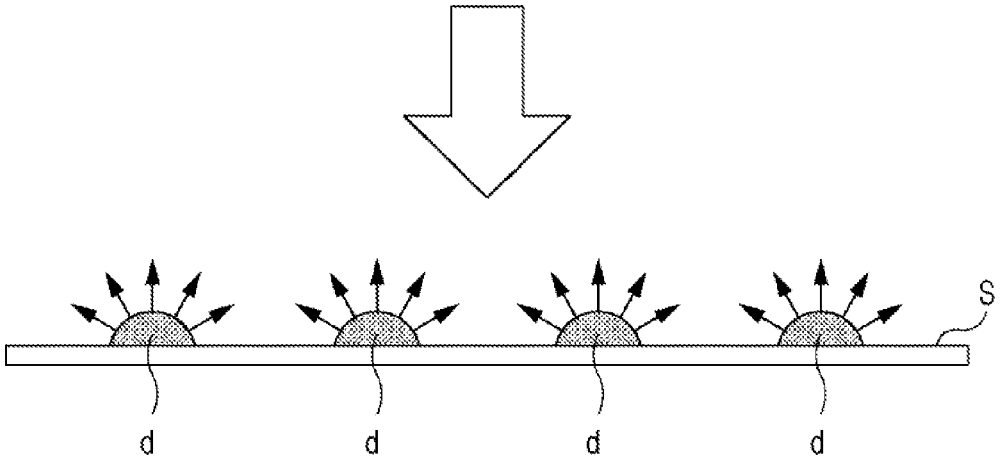
FIG. 1A and FIG. 1B are schematic diagrams illustrating unevenness in glossiness in an image printed by an ink jet printer using a photo-curable ink.
Figure 1B:
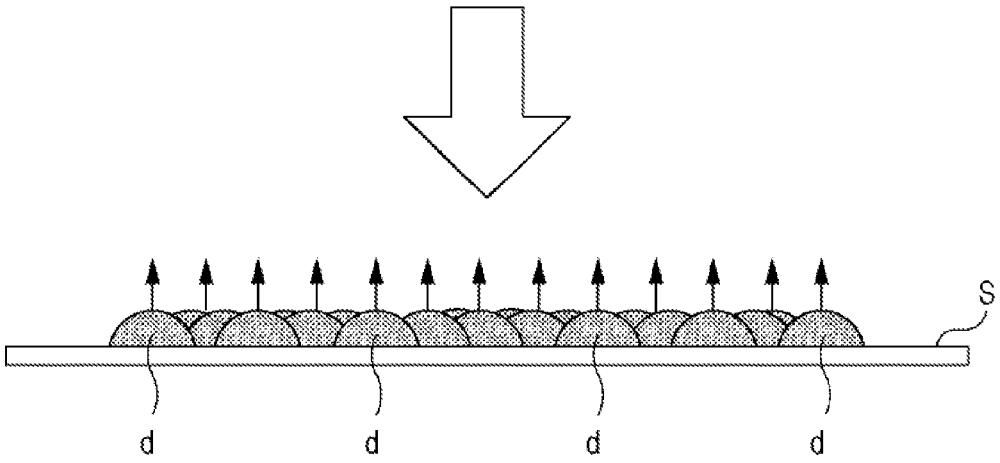

In FIGS. 1A and 1B, schematic diagrams of the glossiness in the image printed by the ink jet printer using the photo-curable ink are illustrated. For example, in a case where a person's face is printed as an image, a part such as a cheek has a light skin color. Then, in the print area of such light color, a launched amount of the ink liquid drop (ink drop) d is small. Then, as illustrated in FIG. 1A, since each ink drop d is cured by the light such as an ultraviolet ray (UV), each ink drop d on the recording medium S forms an independent island shape which is a shape similar to a hemisphere without bleeding. That is, density of the ink drop d becomes "sparse". For this reason, the light incident on the surface of the recording medium S (an outlined arrow in FIGS. 1A and 1B) is reflected at the surface of the island-shaped ink drop d in various directions (solid line arrows in FIGS. 1A and 1B). In other words, it is a diffuse reflection.

On the other hand, as illustrated in FIG. 1B, in a dark part such as a pupil is expressed by a solid coloring of the image area thereof. That is, in the image area, the adjacent ink drops d are disposed close to each other, and even though each ink drop d has a hemisphere shape, it becomes similar to the state that the film-shaped ink is covering the recording medium S. For this reason, the incident light is almost regularly reflected at the film-shaped ink surface, and the glossiness increases. Therefore, in the person's face and the like, a part of skin such as a cheek is in matte tone, and in a part such as a pupil is in gloss tone, and eventually, the image is not natural and has no uniformity in glossiness.

Figure 2:
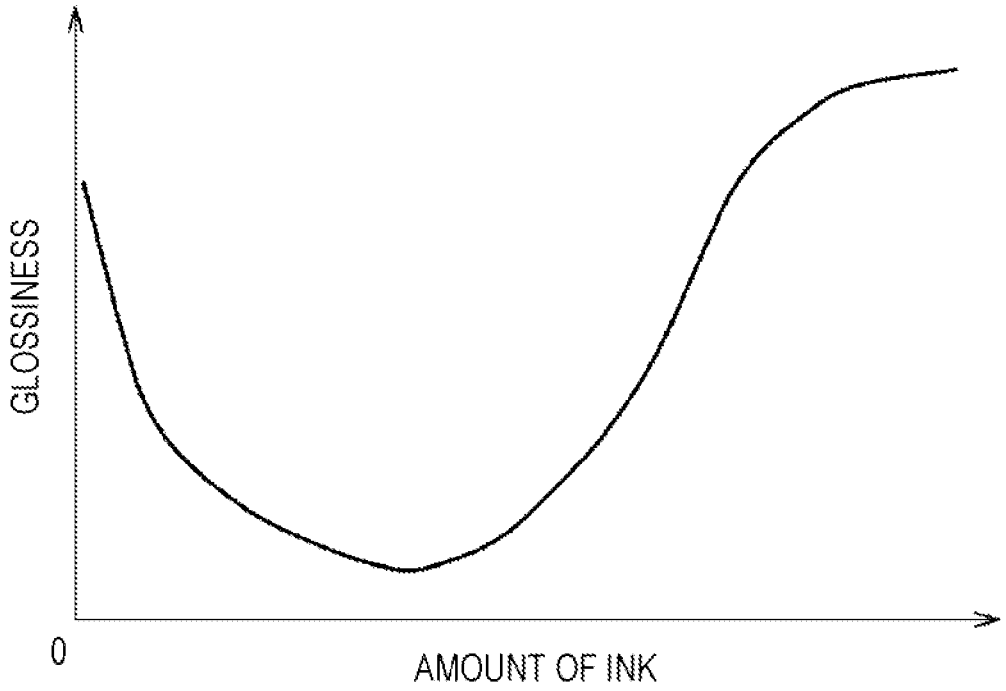
FIG. 2 is a diagram illustrating a relationship between density of the ink on the recording medium and the glossiness.

The above description is an outline of the reasons for the occurrence of the unevenness in the glossiness. However, the occurrence mechanism schematically illustrated in FIGS. 1A and 1B is a simplified model to a certain extent. In reality, the unevenness in the glossiness does not depend only on the density of the ink drop d. The relationship between the density of the ink on the recording medium S and the glossiness is illustrated in FIG. 2. In the Figure, the relationship between the amount of ink (volume) per unit area on the recording medium S and the glossiness measured by a well-known gloss meter (a gloss checker) is illustrated. In a case where the amount of ink is extremely small, the glossiness of the recording medium S is reflected, but when the amount of the ink increases, the diffuse reflection component due to the ink drop d which is disposed sparsely increases, and then the glossiness deteriorates. When the amount of ink per unit area exceeds a predetermined amount, the regular reflection component relatively increases, and then the glossiness also increases.

In addition, the glossiness of the recording medium S itself is different from each other depending on the types of the recording medium S. Therefore, in an application in which the different types of recording media are selectively used, the relationship between the amount of ink and the glossiness becomes further complicated.

Overview of Present Embodiment

As described above, in the printer using the photo-curable ink, the unevenness in glossiness occurs depending on the density of the ink drop on the recording medium. Furthermore, since the glossiness is not proportional to the density of the ink drop, even if a surface-treated recording medium such as a glossy sheet or a matte sheet is used, by the glossiness over the entire image uniformly being changed only, it is not possible to eliminate the unevenness in glossiness on one recording medium. Reforming the property of the ink can be considered, but it is necessary to optimize the physical property relating to the glossiness of the ink itself without impairing the original property of photo-curable ink by which the bleeding can be suppressed. Furthermore, it is also necessary to optimize the method of discharging suitable for such physical property. Consequently, a great deal of time and cost is required for developing and studying the related technology such as the ink technology itself and the discharge control technology.

As a printing method of solving the above described problems, a method of suppressing the occurrence of unevenness in glossiness by forming a printed image using an ink that prints the image (referred to as a color ink) and an ink that controls the glossiness of the image (referred to as a clear ink), can be considered. Specifically, the level of glossiness in the predetermined area on the image formed on the recording medium is adjusted by appropriately changing the amount of clear ink discharge (DUTY of the clear ink) according to the amount of the color ink discharge (DUTY of the color ink) when the image is printed. That is, to obtain a desired gloss value in the image printed using this method, a gloss control table in which the relationship between the color DUTY that is a necessary amount of the color ink per unit area and the clear DUTY that is an amount of the clear ink per unit area is defined, is created by an experiment in advance, and then, the necessary clear DUTY is obtained from the above-described gloss control table and the color DUTY defined by the image data.

However, since the relationship between the color DUTY and the clear DUTY in the gloss control table varies when property of the base material of the recording medium is changed, the required number of the gloss control tables is as many as the number of types of the recording medium to be adapted. For this reason, in a case where a gloss control for the image formed with respect to a new recording medium which does not correspond to the gloss control table registered in the printing apparatus in advance is required to be made possible, it is necessary to obtain a new gloss control table for the new recording medium by an experiment and to store the new gloss control table in the printing apparatus.

Therefore, in the embodiment, in the method of imparting the desired glossiness to the printed image using the color ink that prints the image and the clear ink that adjusts the glossiness of the image, when forming the image on a new recording medium which does not correspond to the gloss control table registered in the printing apparatus in advance, the level of glossiness in the predetermined area on the formed image can be adjusted by performing a minimal measurement and test printing. The amount of discharge of each ink and the image processing method at the time when the actual printing is performed will be described below in detail.

Basic Configuration of Printing Apparatus

The configuration of the printing apparatus used in the embodiment will be described using a line printer (printer 1) as an example.

Configuration of Printer 1

The printer 1 is a printing apparatus that records an image by discharging a liquid such as an ink toward a recording medium such as a sheet, cloth, or a film sheet. The printer 1 is an ink jet type printer. However, as long as the printing apparatus is capable of printing by discharging the ink, the ink jet printer that employs any type of discharging method may be used.

In the printer 1, the image is recorded on the recording medium by discharging, for example, an ultraviolet curable ink (hereafter, UV ink) which is cured by irradiating light such as ultraviolet ray (hereafter, UV). The UV ink is an ink that includes an ultraviolet curable resin. When the UV ink is irradiated by the UV, the UV ink is cured by a light polymerization reaction occurred in the ultraviolet curable resin. In the printing using the UV ink, it is easy to control a degree of curing of the ink dot and a shape of ink dot formed on the recording medium by controlling an amount of the irradiation and the irradiation timing. Therefore, by suppressing the bleed (blur) occurred on the UV ink dots, it is possible to form the image with excellent quality. In addition, by curing the UV ink and forming the dot, it is possible to perform the printing of the recording medium having no ink receptive layer and ink absorption property.

Moreover, in the printer 1 of the embodiment, the image is recorded using ink of four colors: a black (K), cyan (C), magenta (M), and yellow (Y), and a clear ink (CL) which is transparent and colorless, as the UV ink.

Figure 3:
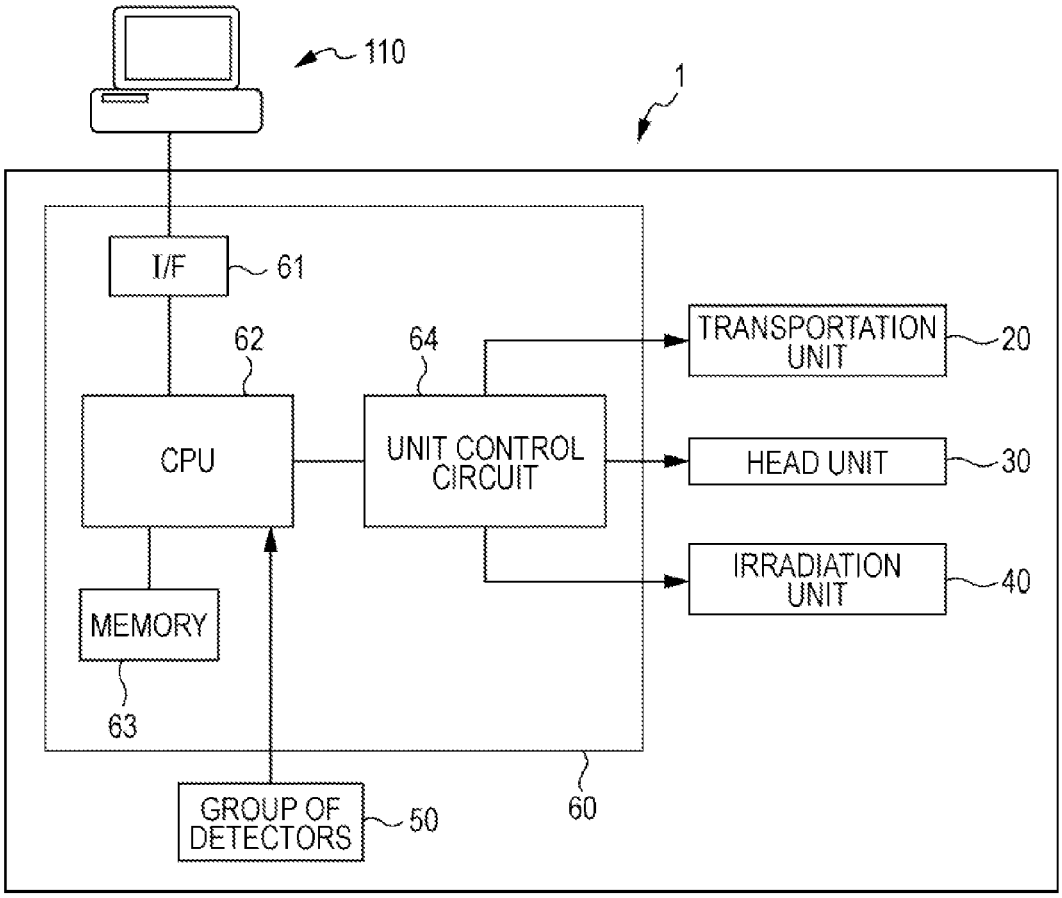
FIG. 3 is a block diagram illustrating an overall configuration of the printer.

FIG. 3 is a block diagram illustrating an overall configuration of the printer 1. The printer 1 includes a transportation unit 20, a head unit 30, an irradiation unit 40, a group of detectors 50, and a controller 60. The controller 60 is a control unit that controls each unit such as the head unit 30 and the irradiation unit 40 based on the print data received from a computer 110 which is an external apparatus. The situation in the printer 1 is monitored by the group of detectors 50, and the group of detectors 50 output the monitored result to the controller 60. The controller 60 controls each unit based on the monitored result output from the group of detectors 50.

Computer 110

The printer 1 is connected to the computer 110 which is an external device so as to communicate with each other. A printer driver is installed in the computer 110. The printer driver is a program for causing a user interface to be displayed on the display apparatus, and causing the image data output from the application program to convert into print data. The printer driver is stored in the recording medium (a recording medium of which the data can be read by the computer) such as a flexible disk FD and a CD-ROM. In addition, the printer driver can be downloaded to the computer 110 via the internet. Moreover, the program is made of various codes that realize a variety of functions.

The computer 110 outputs the print data which corresponds to the image to be printed to cause the printer 1 to print the image. The print data is data having a format that can be interpreted by the printer 1, and includes various command data and pixel data. The command data is data to instruct the printer 1 to perform a specific operation. The examples of the command data include command data to instruct the printer 1 to feed the recording medium, to indicate the amount of transportation of the recording medium, and to discharge the recording medium. In addition, the pixel data is data related to the pixels of the image to be printed.

Here, the pixel is a unit element that forms the image, and the image is formed by the pixels being arrayed in two dimension. The pixel data in the print data is data related to the dots (for example, gradation value) which is formed on the recording medium S (for example, sheet and the like). The pixel data is configured of data with two bits for each pixel. The two-bit pixel data is data that can express one pixel in four gradations.

Transportation Unit 20

Figure 4:
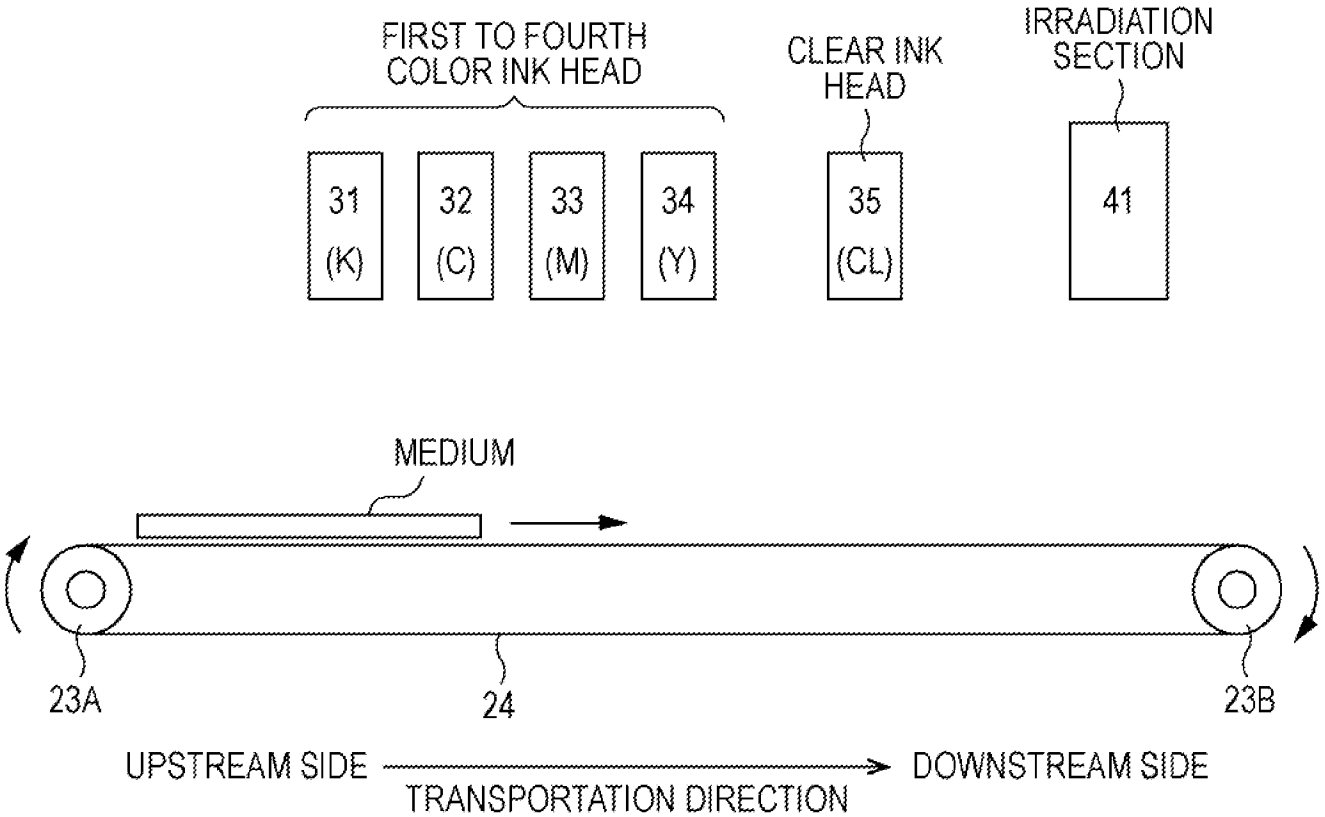
FIG. 4 is schematic side view illustrating the configuration of the printer.

In FIG. 4, a schematic side view representing the configuration of the printer 1 in the embodiment is illustrated.

The transportation unit 20 transports the recording medium toward the predetermined direction (hereafter, refer to as transportation direction). The transportation unit 20 includes a transportation roller 23A of the transportation direction upstream side, a transportation roller 23B of the transportation direction downstream side, and a belt 24 (FIG. 4). When a transportation motor (not illustrated) rotates, then the transportation roller 23A of the upstream side and the transportation roller 23B of the downstream side rotate, and the belt 24 rotates. The recording medium fed by a recording medium feeding roller (not illustrated) is transported to the printable area (an area facing the head unit 30 described below) by the belt 24. The recording medium passed through the printable area is discharged to the outside by the belt 24. Moreover, the recording medium being transported is vacuum adsorbed or electro-statically adsorbed to the belt 24.

Head Unit 30

The head unit 30 discharges the UV ink on the recording medium. The head unit 30 forms an ink dot by discharging the color ink (KCMY) and the clear ink (CL) having each color with respect to the recording medium being transported, and prints the image on the recording medium. The printer 1 in the embodiment is a line printer; each head of the head unit 30 can form a large number of dots of the recording medium width at a time.

In the printer 1 illustrated in FIG. 4, color ink heads 31 to 34 are provided that discharge the color ink from the upstream side of the transportation direction in the order. The color ink head is configured from a first color ink head 31 (hereafter, also called a first head 31), a second color ink head 32 (hereafter, also called a second head 32), a third color ink head 33 (hereafter, also called a third head 33), and a fourth color ink head 34 (hereafter, also called a fourth head 34). In the embodiment, the black ink (K) is discharged from the first head 31, the cyan ink (C) is from the second head 32, the magenta ink (M) is from the third head 33, and the yellow ink (Y) is from the fourth head 34, respectively. However, it is optional that the ink having which color is discharged from the color ink heads 31 to 34 respectively. For example, the yellow ink (Y) may be discharged from the first head 31, the black ink (B) may be discharged from the second head 32. Furthermore, in addition to the color ink heads 31 to 34, a color ink head that discharges the ink having colors other than the above-described KCMY (for example, light cyan and metallic color) may be provided. In addition, the first head 31 and the second head 32 may discharge the ink having the same color. For example, the first head 31 and the second head 32 may discharge the cyan ink (C).

In the transportation direction downstream side of the fourth color ink head 34, a clear ink head 35 that discharges the clear (CL) UV ink which is transparent and colorless. Here, the clear (CL) ink is an ink which is generally called "a clear ink" and which does not include, or includes a small amount of coloring material, if any. Hereafter, the clear ink head 35 is also called fifth head 35.

Each head is made of a plurality of short heads, and the short head includes a plurality of nozzles that are discharge ports for discharging the UV ink.

Figure 5A:
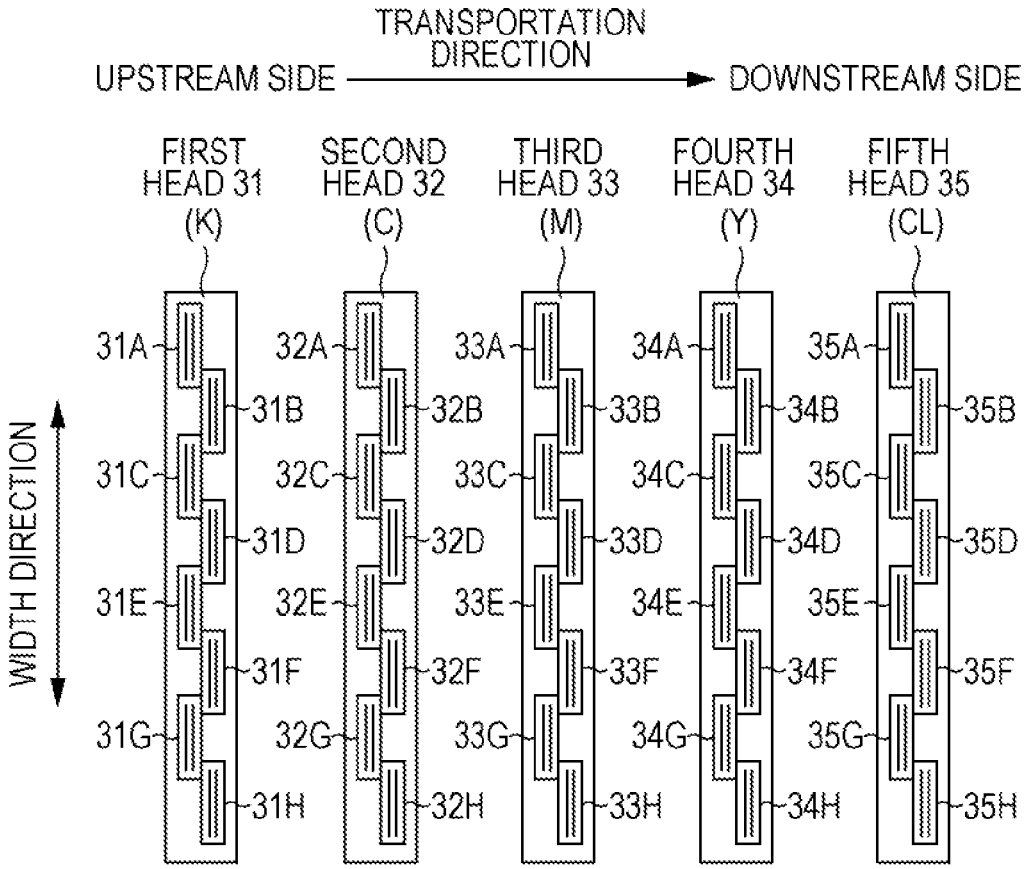
FIG. 5A is a diagram explaining an array of a plurality of short heads in a color ink head and a clear ink head of a head unit.
Figure 5B:
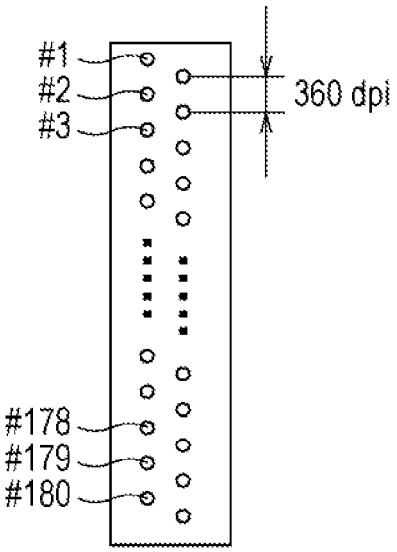
FIG. 5B is a diagram explaining a state of the nozzle array disposed at the bottom of each head.

FIG. 5A is a diagram explaining an array of a plurality of short heads in the color ink heads 31 to 34 and the clear ink head 35 of a head unit 30. FIG. 5B is a diagram explaining a state of the nozzle array disposed at the bottom of each head. Moreover, FIGS. 5A and 5B are diagrams of nozzles virtually seen from the upper surface.

In the first head 31, eight short heads 31A to 31H are arrayed in a staggered column shape along the width direction of the recording medium which is a direction crossing the transportation direction of the recording medium. Similarly, in the second head 32, eight short heads 32A to 32H are arrayed in a staggered column shape along the width direction. In addition, it is similar to the third head 33, the fourth head 34, and the fifth head 35 (FIG. 5A). In the example of FIG. 5A, each head is configured of eight short heads. However, the number of short heads that configure each head may be more than eight or may be less than eight.

A plurality of nozzle arrays is formed in each short head (FIG. 5B). Each nozzle array respectively includes 180 nozzles that discharge ink, and the nozzles are arrayed from #1 to #180 in a certain pitch (for example, 360 dpi) along the width direction of the recording medium. In a case of FIG. 5B, two columns of nozzles are arrayed in parallel, and the nozzles of each nozzle column is provided on the position deviated by 720 dpi each in the width direction of the recording medium. Moreover, the number of nozzles in one column is not limited to 180 nozzles. For example, one column may include 360 nozzles or may include 90 nozzles. In addition, the number of nozzle columns provided in each short head is not limited to two columns.

In each nozzle, an ink chamber and piezo-element which is a piezoelectric element (both are not illustrated) are provided. The piezo-element is driven by a drive signal COM generated by a unit control circuit 64. Then, the ink filled in the ink chamber is discharged from the nozzle due to the expansion and contraction of the ink chamber by the driving of the piezo-element.

In the printer 1, a plurality of kinds of ink liquid drop having a different size (different amount of ink) depending on the magnitude of a pulse applied to the piezo-element according to the drive signal COM can be discharged from each nozzle. For example, from each nozzle, three kinds of ink can be discharged, those are: a large ink drop that has an amount of ink enough to form a large dot, a medium ink drop that has an amount of ink enough to form a medium dot, and a small ink drop that has an amount of ink enough to form a small dot. Then, each nozzle forms a dot line (a raster line) along the transportation direction of the recording medium by the intermittent discharge of the ink drop from each nozzle of the recording medium being transported.

Irradiation Unit 40

The irradiation unit 40 irradiates the UV toward the UV ink dot landed on the recording medium. The dot formed on the recording medium is cured by receiving the irradiation of the UV from the irradiation unit 40. The irradiation unit 40 in the embodiment includes an irradiation section 41.

The irradiation section 41 is provided on the downstream side of the transportation direction of the clear ink head 35 (FIG. 4), and irradiates the UV for curing the UV ink dot formed on the recording medium by the color ink heads 31 to 34 and the clear ink head 35. The length of the irradiation section 41 in the width direction of the recording medium is equal to or longer than the width of the recording medium.

In the embodiment, the irradiation section 41 includes a light emitting diode (LED) as a light source for irradiation of the UV. Irradiation energy of the LED can easily be changed by controlling the amount of input current. In addition, a light source other than the LED such as a metal halide lamp may be used as the irradiation section 41. The light source of the irradiation section 41 is separated from the clear ink head 35 (and the color ink heads 31 to 34) by being accommodated in the irradiation section 41. In this way, the UV irradiated from the light source can be prevented from leaking to the bottom surface of the clear ink head 35. Accordingly, a nozzle clogging or the like generated by the UV ink being cured in the vicinity of the opening of each nozzle formed on the bottom surface is suppressed.

Moreover, in FIG. 4, only one irradiation section 41 is provided on the most downstream of the transportation direction as the irradiation unit 40. However, the irradiation unit 40 may be configured to include the irradiation section 41 provided on the downstream of each ink head of each color, respectively. At that time, the irradiation unit 40 may be configured to further include the irradiation section 42 (not illustrated) on the most downstream side of the transportation direction, then the UV is irradiated from the irradiation section 41 and the irradiation section 42, thus, the UV ink dot may be cured in a two-step process. For example, from the irradiation section 41, the UV is irradiated with the energy to the extent of curing the surface of the UV ink dot (temporary curing), and at the final step of transportation of the recording medium, the UV is irradiated with the energy to the extent of curing the entire of the UV ink dot (complete curing) from the irradiation section 42. In this way, by adjusting the curing degree of the UV ink dot, when the UV ink dot is discharged from each head, it is possible to suppress the occurrence of a problem in that the landing position of the dot is deviated due to the splash of the UV ink dot with the high curing degree.

Group of Detectors

The group of detectors 50 include a rotary type encoder (not illustrated), a recording medium detection sensor (not illustrated), and the like. The rotary type encoder detects an amount of rotation of the upstream side transportation roller 23A and an amount of rotation of the downstream side transportation roller 23B. An amount of transportation of the recording medium can be detected based on the detection result of the rotary type encoder. The recording medium detection sensor detects the position of the front end of the recording medium during the transportation of the recording medium.

Controller

The controller 60 is a control unit for performing the control of the printer. The controller 60 includes an interface unit 61, a CPU 62, a memory 63 as a storage unit, and a unit control circuit 64.

The interface unit 61 performs data transmitting and receiving between the computer 110 which is an external apparatus and the printer 1. The CPU 62 is an arithmetic processing unit for performing the control of entire printer 1. The memory 63 secures an area for storing the program of the CPU 62 and the operation area, and is configured to include an RAM, EEPROM, and the like. In addition, in the memory 63, a plurality of base material information including the gloss control table for each base material generated in advance by the test printing with respect to the plurality of types of base materials, are stored. This base material information, to form the image having a desired glossiness in the step of printing the image using the printer 1, is data used for creating a gloss control table of a base material of a new recording material on which the image is to be formed, and the details of the data will be described below. Then, the CPU 62 controls each unit such as transportation unit 20 via the unit control circuit 64 according to the program stored in the memory 63.

Regarding Image Printing Operation

The image printing operation by the printer 1 will be briefly described.

When the printer 1 receives the print data from the computer 110, the controller 60 firstly causes the recoding medium feeding roller (not illustrated) to rotate by transportation unit 20, and send the recording medium on which the image is to be printed, onto the belt 24. The recording medium is transported on the belt 24 in a certain speed without stopping, and then passes under the head unit 30 and the irradiation unit 40.

During this time, by intermittently discharging the color ink (KCMY) from each nozzle of color ink heads 31 to 34, a letter or the image formed from the color ink dot is formed on the recording medium. In addition, by intermittently discharging the clear ink (CL) from each nozzle of clear ink head 35, the clear ink dot is formed on the predetermined pixel. Then, the color ink dot and the clear ink dot are cured by the UV irradiated from the irradiation section 41 of the irradiation unit 40. In this way, the image is printed on the recording medium.

Finally, the controller 60 discharges the recording medium on which the printing of the image is finished.

Relationship Between Ink DUTY and Glossiness

Relationship Between Color DUTY and Clear DUTY

How the glossiness of the image changes according to the relationship between the amount of discharge of the color ink per unit area which forms the image (hereafter, called color DUTY) and the amount of discharge of the clear ink per unit area which adjusts the glossiness (hereafter, called clear DUTY), will be described.

Figure 6:
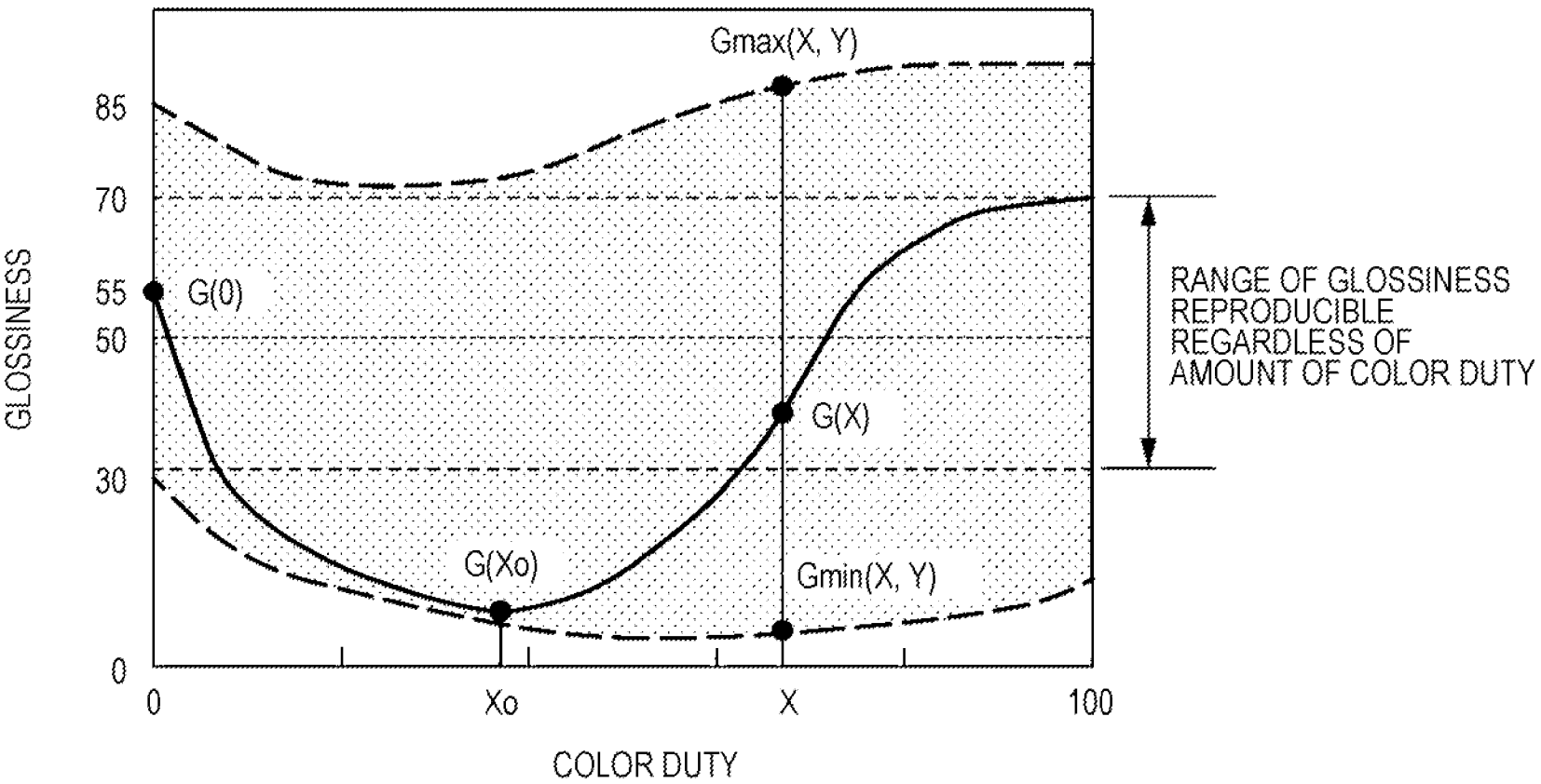
FIG. 6 is a diagram illustrating an example of a relationship between a color DUTY and the glossiness.

FIG. 6 is a diagram illustrating an example of the relationship between the color DUTY and the glossiness. The horizontal axis in FIG. 6 represents the amount of discharge of the color ink per unit area (color DUTY) and the vertical axis in FIG. 6 represents the level of glossiness of the image formed by the color ink (and the clear ink).

First, a thick solid line in FIG. 6 illustrates the glossiness of the image in a case where the image is printed with changing the amount of discharge per unit area (color DUTY) only using the ink for forming the image (here, the color ink). In FIG. 6, the glossiness of the printed image is assumed to be represented by G (X) when the amount of color DUTY is represented by (X). In a case where the printing is performed using only the color ink, the relationship between the color DUTY and the glossiness of the image is illustrated as similar to that described in FIG. 2. For example, when the X=0% (color ink DUTY is zero), the glossiness value G (0) of the recording medium itself is illustrated as 55. Then, with the increase of the color DUTY (X), the glossiness G (X) gradually decreases, and the glossiness G (Xo) becomes minimal when the color DUTY becomes a predetermined value Xo %. Subsequently, with the increase of the color DUTY (X), the glossiness G (X) gradually increases. In this manner, in a case where only the color ink is used, the level glossiness G (X) in a certain portion of the image is determined by the color ink DUTY value (=X %) on that portion. In other words, since the glossiness is determined by the gradation value of the color on the portion (pixel) that configures the image, in the formed image, a difference in glossiness is generated for each portion where the gradation is different.

Therefore, the glossiness of the entire image is adjusted by further discharging the predetermined amount of clear ink for each area (portion) of the image in addition to the color ink. Here, the glossiness of the printed image is assumed to be represented by G (X, Y) when the amount of clear DUTY is (Y) and the color DUTY is (X).

For example, the glossiness G (0) is 55 when X=0. However, by discharging the clear ink, the glossiness can be changed. In FIG. 6, the glossiness G (0, Y) of the image can be changed to vary in a range from 30 to 85 by changing the clear DUTY (Y) in a range from zero to 100%. Similarly, of a predetermined amount of color DUTY (X), the glossiness G (X, Y) of the image can be changed to vary in a predetermined range by changing the clear DUTY (Y).

In FIG. 6, a colored area surrounded by dot lines illustrates the range of the glossiness level measured from the image formed by the color ink and the clear ink. The upper dot line in the diagram represents the upper maximum value Gmax (X, Y) of the glossiness reproducible by changing the clear DUTY value (Y) of a predetermined color DUTY value (X). In addition, the lower dot line in the diagram represents the lower minimum value Gmin (X, Y) of the glossiness reproducible by changing the clear DUTY value (Y) of a predetermined color DUTY value (X). That is, by appropriately adjusting the values of the color DUTY (X) and the clear DUTY (Y) respectively, it is possible to freely adjust the glossiness of the image if it is within the colored area in FIG. 6. Then, in a case of FIG. 6, the image can be formed with the glossiness of 30 to 70 by adjusting the amount of clear DUTY (Y) even though the amount of color DUTY (X) is in any value.

Figure 7:
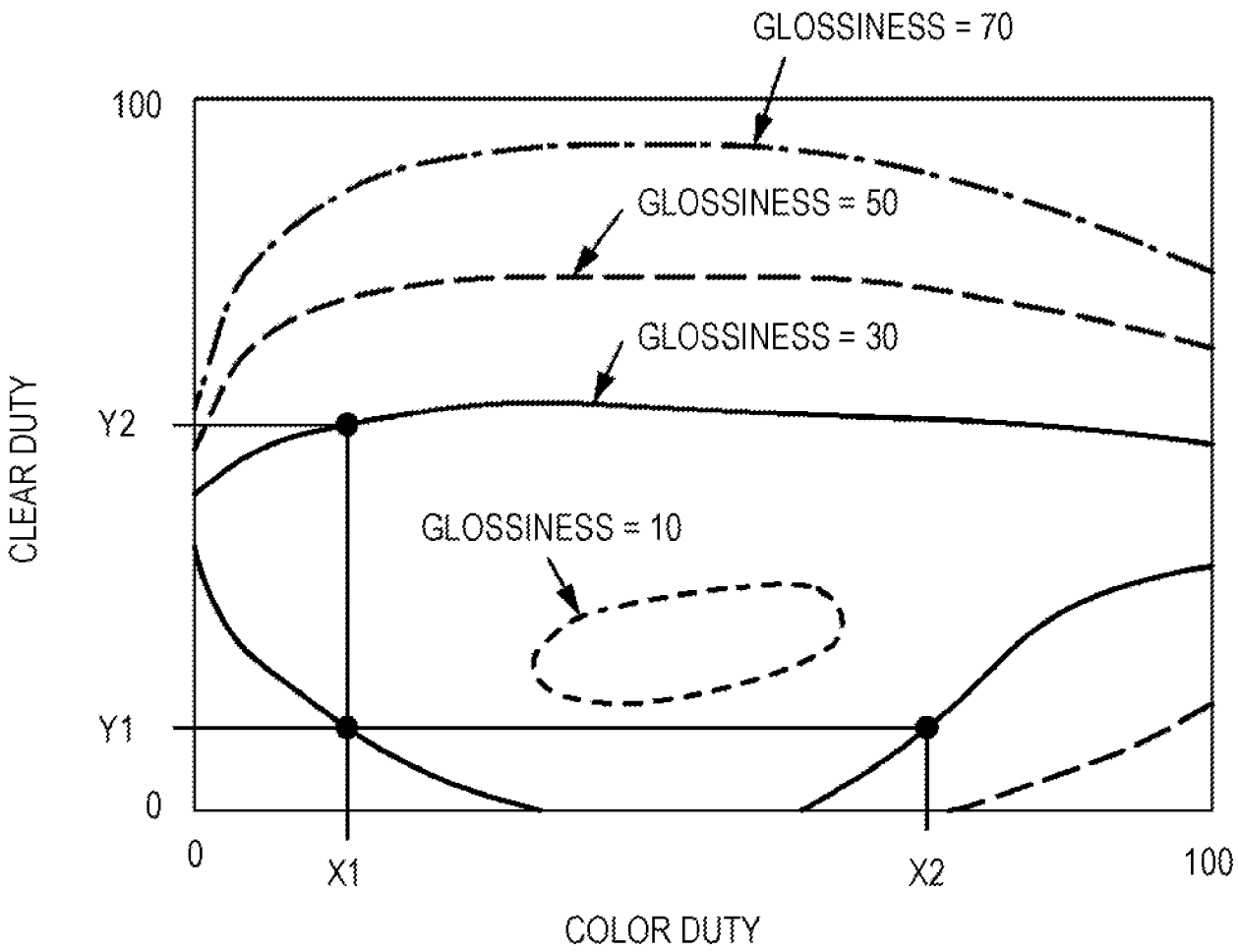
FIG. 7 is a diagram illustrating a glossiness of an image in a case where the color DUTY and the clear DUTY are changed in FIG. 6.

FIG. 7 is a diagram illustrating the glossiness of the image in a case where the color DUTY and the clear DUTY in FIG. 6 are changed. The vertical axis in the diagram represents the clear DUTY and the horizontal axis represents the color DUTY. Then, in the diagram, curved lines look like contour lines represent the level of the glossiness. That is, FIG. 7 illustrates the relationship between the sum of the amount of the color ink discharge and the amount of the clear ink discharge and the glossiness of the image formed thereof. For example, when the image is printed, in a case where the color ink is discharged such that the color DUTY is (X1), to print the image with the level of the glossiness being 30, the clear ink may be discharged such that the clear DUTY is (Y1) or (Y2). Contrarily, in a case where the clear DUTY is (Y1), the color DUTY required to print the image with the level of the glossiness being 30 is (X1) or (X2).

If the relationship in FIG. 7 is revealed, it is possible to print the image having a desired glossiness by appropriately selecting the amount of clear DUTY (Y) of the color DUTY (X). The invention provides a printing method that includes the method of adding the gloss control table which realizes the gloss control for adjusting the glossiness of the image formed of the base material of new recording material to the desired glossiness by a minimized number of test printings and the measurements.

First Embodiment

Next, a first embodiment of the printing method in the invention will be described along with the drawings. In the first embodiment, at the time of printing the image, the relationship corresponding to FIG. 7 described above of the recording medium on which the image is printed is obtained in advance, and then the glossiness of the entire printed image is adjusted by changing the amount of clear DUTY according to the amount of color DUTY based on the relationship.

In the embodiment, two steps; a step of adding the gloss control table and a step of printing are implemented, the printing is performed while adjusting the amount of the clear DUTY with respect to the color DUTY. Firstly, in the step of adding the gloss control table, the relationship corresponding to FIG. 7 with respect to a new recording medium on which the image is to be printed is obtained, and is stored in the printer 1. Specifically, using the relationship between the sum of the amounts of the color DUTY and the clear DUTY of the base material of a plurality of recording media stored in the printer 1 in advance and the glossiness of the image, the relationship between the sum of the amounts of the color DUTY and the clear DUTY of the base material of a new recording medium on which the image is to be printed and the glossiness of the image is obtained, and is stored. Then, based on the relationship obtained in the step of adding the gloss control table, the color image processing and the clear image processing are performed so as to get the desired glossiness in the step of printing, and then the amount of clear ink discharge with respect to the color ink is adjusted to print the image. Hereafter, each step will be described in detail.

Figure 8:
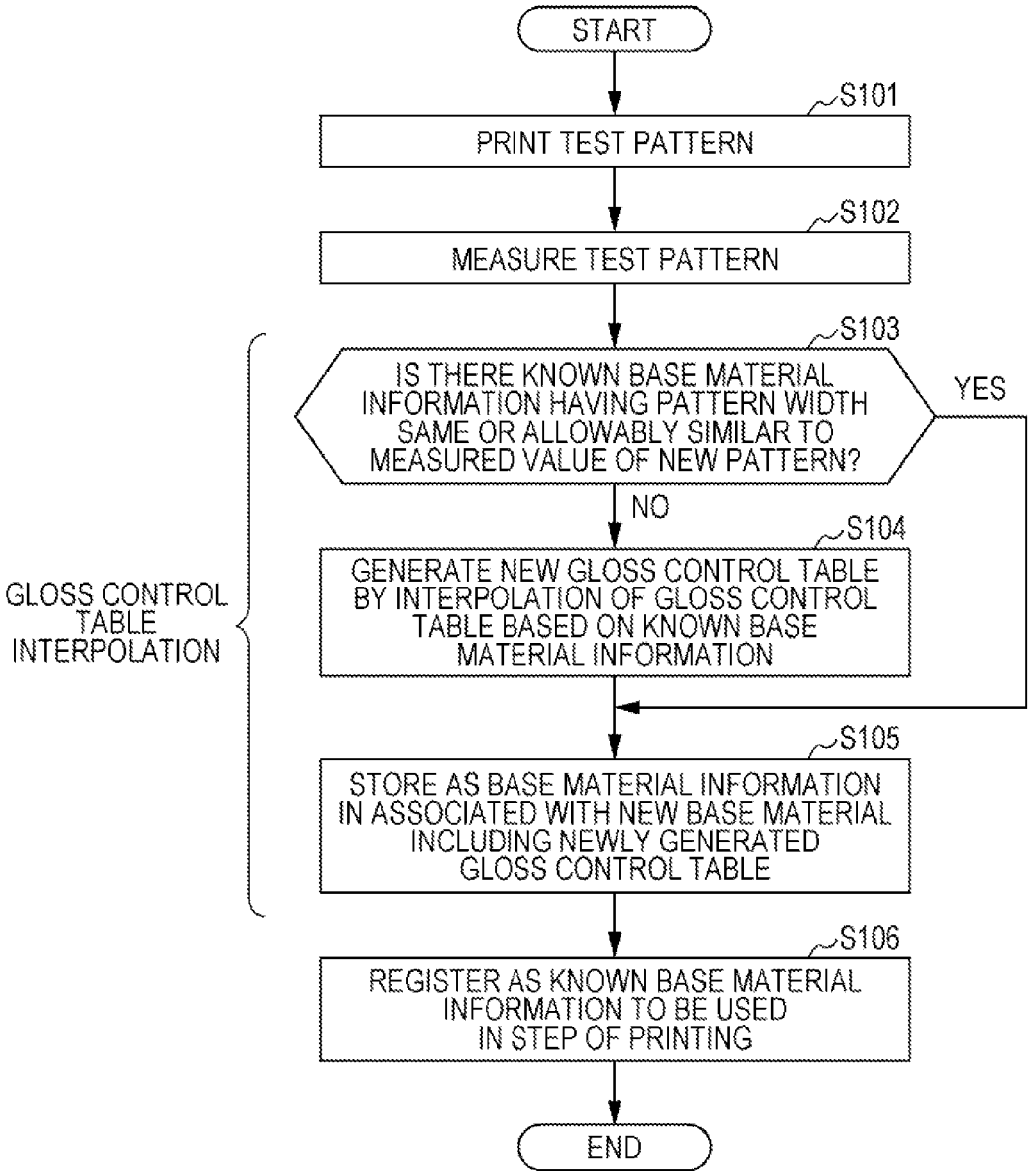
FIG. 8 is a flow chart illustrating a method of adding a gloss control table in the printing method in the first embodiment.
Figure 9:
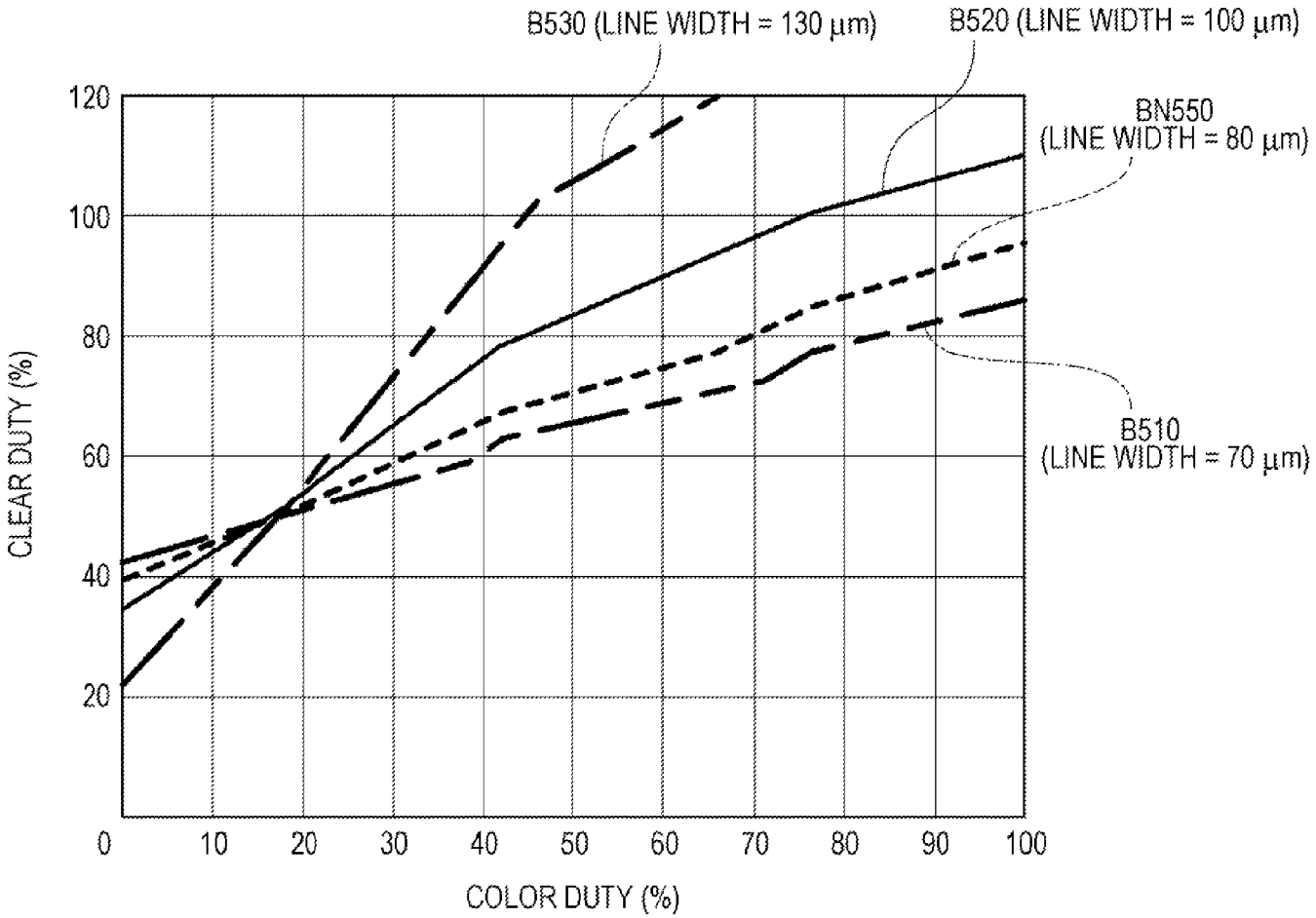
FIG. 9 is an explanatory diagram illustrating base material information that includes a gloss control table for each base material in the first embodiment.

FIG. 8 is a flow chart illustrating the method of adding the gloss control table in the printing method in the first embodiment. In addition, FIG. 9 is an explanatory diagram illustrating base material information that includes the gloss control table for each base material in the first embodiment.

In the printing method in the first embodiment, in the method of adding the gloss control table illustrated in FIG. 8, firstly, as illustrated in STEP S101, a test pattern is printed using a predetermined amount of predetermined ink with respect to a base material (new base material) of the new recording medium which is to be added from now on. In the embodiment, a predetermined amount of clear ink is discharged from the clear ink head 35 of the head unit 30, and the ink pattern landed on the new base material is cured by performing the UV irradiation from the irradiation section 41 of the irradiation unit 40, and then the test pattern having a predetermined shape is formed.

Next, as illustrated in STEP S102, a predetermined shape portion (for example, line width portion) of the test pattern formed in STEP S101 is measured (pattern measuring step). The pattern measured value (measured value for the new pattern) obtained in the step of pattern measuring is input to, for example, the memory 63 of the printer 1 to be kept temporarily. Here, in the embodiment, the measured value (for example, line width) for the new pattern with respect to the new base material obtained in STEP S102 is assumed to be 80 μm.

Next, in the controller 60 as a control unit, the measured value of new pattern input to the memory 63 in STEP S102 is collated with the measured values of a plurality of known patterns such as a first pattern measured value and a second pattern measured value which are included in the base material information stored in the memory 63 in advance, and then an gloss control table interpolation is performed, by which the new gloss control table with respect to the new base material is obtained using a predetermined interpolation method. Hereafter, the gloss control table interpolation step will be described in detail.

Regarding Base Material Information

First, the base material information which is used in gloss control table interpolation step will be described.

In the base material information, in the printer 1 in the embodiment, the gloss control table that defines the relationship between the color DUTY which is the amount of color ink discharged on the unit area of the image forming surface of a plurality of kinds of recording media made of different base materials registered in the memory 63 as the storage unit in advance, the clear DUTY which is the amount of clear ink discharged on the unit area, and the glossiness of the image formed by the color DUTY and the clear DUTY discharged of the unit area; and the pattern measured value of the predetermined shape (for example, line width) of the test pattern formed from the predetermined amount of discharged ink on the recording medium; are associated each other. In the embodiment, as illustrated in FIG. 9, three kinds of base material information such as a first base material information B510, a second base material information B520, and a third base material information B530 are stored in the memory 63 in advance. However, the known base material information may be base material information with respect to four or more kinds of base material as long as the number is plural.

The base material in FIG. 9 will be described. In the first base material information B510, a first gloss control table that is the gloss control table of a first base material which is the base material of a first recording medium and the first pattern measured value obtained by measuring the predetermined shaped-portion (for example, line width) of the test pattern after printing the test pattern using the predetermined amount of predetermined ink of the first base material, are associated each other. The first pattern measured value is assumed to be 70 μm.

In addition, in the second base material information B520, a second gloss control table that is the gloss control table of a second base material which is the base material of a second recording medium different from the first base material and the second pattern measured value obtained by measuring the predetermined shaped-portion (for example, line width) of the test pattern after printing the test pattern using the predetermined amount of predetermined ink of the second base material, are associated each other. The second pattern measured value is assumed to be 100 μm.

In addition, in the third base material information B530, a gloss control table with respect to a third base material that is a base material of a third recording medium which is different from any of the first base material and the second base material and the pattern measured value obtained by measuring the predetermined shaped-portion (for example, line width) of the test pattern after printing the test pattern using the predetermined amount of predetermined ink of the base material, are associated each other. The pattern measured value is assumed to be 130 μm.

In this way, if the evaluation pattern is formed by discharging the predetermined ink on the base materials different from each other and the predetermined shaped-portion of the evaluation pattern is measured, it is known that the difference in measured values at the predetermined shaped-portion occur due to the difference of the surface state such as a contact angle with respect to the ink on the surface of each base material and a surface roughness.

Moreover, the gloss control table (the first, the second, and the third gloss control table) in the first base material information B510, the second base material information B520, and the third base material information B530 illustrated in FIG. 9 are tables that define the amount of clear ink (clear DUTY) with which the glossiness becomes minimum with respect to the amount of color ink (color DUTY).

However, the gloss control table of each base material information is not limited to the above, but may be the table that defines the amount of clear ink (clear DUTY) with which the glossiness not becomes minimum but becomes the predetermined level of glossiness with respect to the amount of color ink (color DUTY).

Back to FIG. 8, in the step of gloss control table interpolation of the step of adding the gloss control table, firstly, as illustrated in STEP S103, whether or not there is known (registered in the printer 1) base material information having pattern measured value that is same or allowably similar to the measured value of new pattern (in the embodiment, the line width 80 μm) obtained in STEP S102, is determined.

In a case where there is base material information having pattern measured value that is same or allowably similar to the measured value of new pattern (YES in STEP S103), the gloss control table of the base material information is kept in the memory 63 as the gloss control table used with respect to the new base material (recording medium) (STEP S105).

As described above, in the embodiment, the pattern measured values included in the known base material information illustrated in FIG. 9 are 70 μm in the first base material information B510, 100 μm in the second base material information B520, and 130 μm in the third base material information B530, and the difference of the measured value 80 μm of the new pattern is equal to or greater than 10 μm. Like this, in STEP S103, in a case where there no gloss control table having pattern measured value that is same or allowably similar to the measured value of new pattern (NO in STEP S103), the process proceeds to STEP S104.

In STEP S104, in the controller 60, a gloss control table interpolation step by which a new gloss control table with respect to the new base material (a fourth base material) is implemented using a predetermined measured value interpolation method based on the first base material information B510, the second base material information B520, and the third base material information B530. Here, as the predetermined measured value interpolation method, well known interpolation methods, for example, a tetrahedral interpolation, a variable function fitting (two variable function least-squares method), a two-dimensional Pade approximation interpolation method (an interpolation method in which a two dimensional Taylor expansion of a finite number of items is approximated to a polynomial fractional function), a proportional calculation, or the like can be used. More specifically, two pieces of base material information that have the measured value of the new pattern of the new base material are selected among the first base material information B510, the second base material information B520, or the third base material information B530. Here, the pattern measured values in the first base material information B510 is 70 μm, in the second base material information B520 is 100 μm, and in the third base material information B530 is 130 μm, and since the measured value of the new pattern is 80 μm, the first base material information B510 and the second base material information B520 are selected as two pieces of base material information. Next, using the first gloss control table included in the first base material information B510 and the second gloss control table included in the second base material information B520, the new gloss control table with respect to the new base material is obtained by adapting the measured value interpolation method described above.

In this way, by the measured value interpolation method in STEP S104, base material information BN550 that includes a new gloss control table corresponding to the new base material (recording medium) illustrated by a dashed line in FIG. 9 can be obtained.

Next, as illustrated in STEP S105, a gloss control table of the new base material information BN550 obtained by the gloss control information interpolation method is stored in the memory 63 in associated with the new base material.

Then, the new base material information BN550 is registered in the memory 63 as the known base material information (STEP S106) together with the first base material information B510, the second base material information B520, and the third base material information B530. Now, the method of adding the gloss control table corresponding to the base material (new base material) of the new recording medium on which the image is to be printed ends.

By the step of adding the gloss control table described above, when printing the image on the new recording medium, the relationship between the color DUTY and the clear DUTY for printing the image with a targeted glossiness becomes apparent.

Step of Printing

When performing the printing, the processing actually performed in the printer 1 will be described.

In the step of printing, the printing of the image is performed using the printer 1 so as to get the desired glossiness (such that the unevenness in glossiness is small) by a user. The print image is formed by discharging the color ink on each predetermined area. Then, with respect to the amount of the color ink discharged per unit area (color DUTY), the glossiness of the printed image is adjusted to the desired level by discharging the clear ink of which the amount is determined based on the relationship obtained in the step of adding the gloss control table described above.

Figure 10:
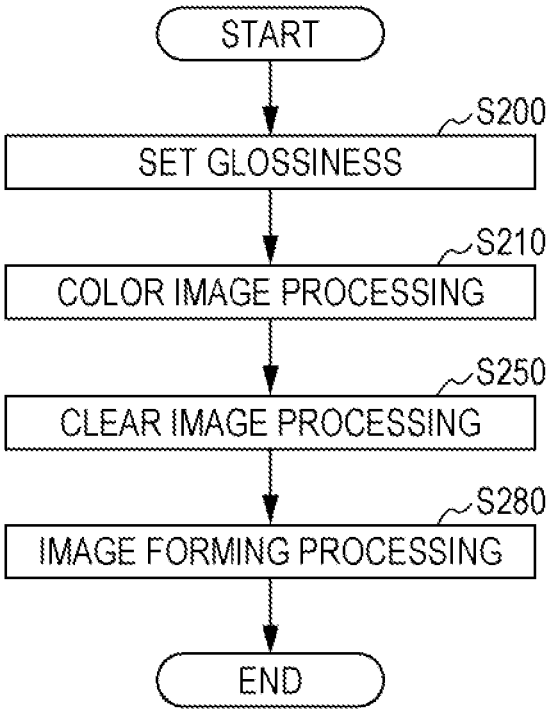
FIG. 10 is a flow chart illustrating an entire flow of step of printing in the first embodiment.

FIG. 10 illustrates an entire flow of step of printing in the first embodiment. The step of printing includes a step of glossiness setting (STEP S200), a step of color image processing for performing the step of printing the image by discharging the color ink (STEP S210), a step of clear image processing for defining the amount of clear ink discharge for each area based on the amount of the color ink discharge (STEP S250), and an image forming and processing step for actually forming the image by discharging the color ink and the clear ink (STEP S280).

STEP S200: Setting Glossiness

First, a user sets the glossiness (target glossiness) of the image to be printed (STEP S200). For example, the glossiness levels such as matte tone (glossiness: approximately 30), semi-gloss tone (glossiness: approximately 50), and gloss tone (glossiness: approximately 70) are prepared to be displayed on a user interface (not illustrated) so as to be selected. Alternatively, the target glossiness may be input by a numerical value.

Moreover, the setting of the glossiness (STEP S200) may be performed after the color image processing (STEP S210) described below.

STEP S210: Color Image Processing

Figure 11:
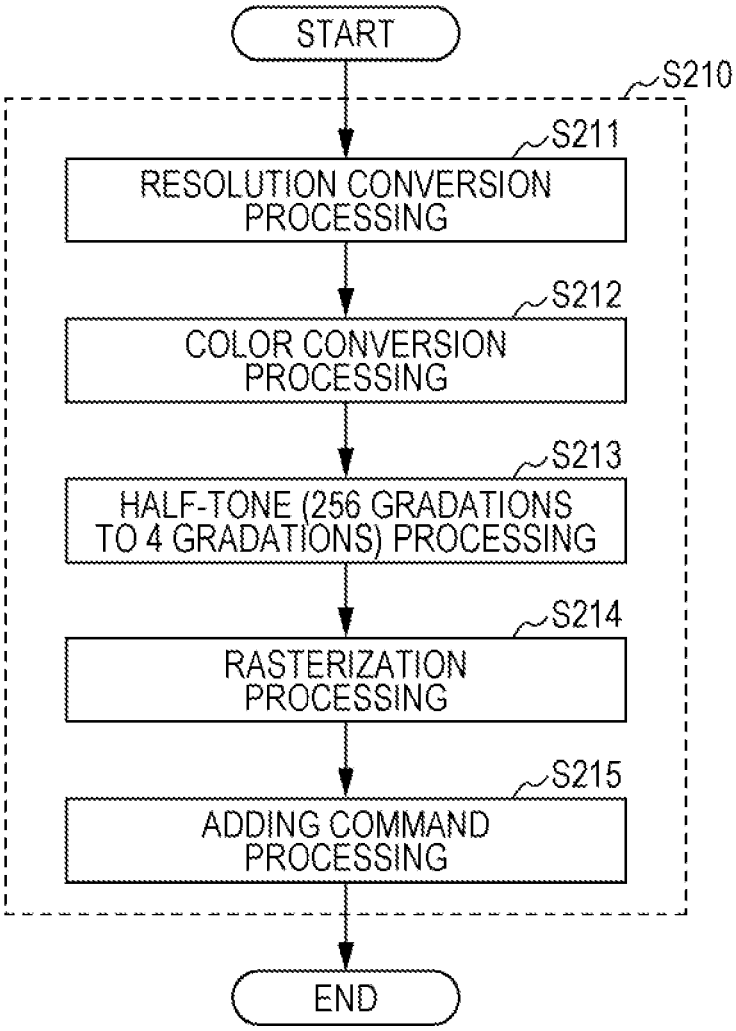
FIG. 11 is a flow chart of a processing performed by a printer driver in a color image processing.

When the user of the printer 1 instructs to print the image drawn on an application program, the printer driver of the computer 110 starts to operate. The printer driver receives the image data from the application program, and converts the image data into the print data in a format that can be interpreted by the printer 1, and then output the print data to the printer 1. At the time when the image data from the application program is converted into the print data, the printer driver performs resolution conversion processing, color conversion processing, half-tone processing, and the like. In FIG. 11, a flow chart showing the flow of processing performed by the printer driver in the color image processing is illustrated.

First, the processing (the resolution conversion processing) is performed (STEP S211), in which the image data (text data, image date, or the like) output from the application program is converted into the data having a resolution (printing resolution) for being printed on the recording medium. For example, in a case where the printing resolution is designated as 720×720 dpi, the image data of a vector format received from the application program is converted into the image data of the bitmap format having a resolution of 720×720 dpi.

Here, each pixel data of the image data after the resolution conversion processing is RGB data having each gradations (256 gradations, for example) expressed by the RGB color space.

Next, the color conversion processing in which the RGB data is converted into the data of CMYK color space is performed (STEP S212). The image data of CMYK color space is the data corresponding to the colors of the ink that the printer has. The color conversion processing is performed based on a table (color conversion look-up table, LUT) in which the gradation values of the RGB data and the gradation values of the CMYK data are associate with each other.

Here, the pixel data after the color conversion processing is 8 bit CMYK data having 256 gradations expressed by the CMYK color space. Since that data is also used in the clear image processing (STEP S250) described below, the data is duplicated to be temporarily stored in the memory 63 or the like.

Next, the half-tone processing in which the data with the high number of gradations is converted into the data with the number of gradations that the printer is capable of forming, is performed (STEP S213). By the half-tone processing, for example, the data indicating 256 gradations is converted into the one bit data indicating two gradations or two bit data indicating four gradations. In the half-tone processing, a dither method, a γ correction, an error diffusion method, or the like is used. The data after the half-tone processing has a resolution same as the printing resolution (for example, 720×720 dpi). In the image data after the half-tone processing, one bit pixel data or two bit pixel data corresponds to each pixel, the pixel data indicates the dot forming situation (an existence of the dot, the size of the dot) on each pixel.

Then, a rasterization processing in which the pixel data arranged in a matrix shape is rearranged for each pixel data in an order of data subject to be transported to the printer 1 is performed (STEP S214). For example, the pixel data is rearranged in an order corresponding to the order of nozzles in each nozzle array.

A command addition processing in which command data corresponding to the printing method is added to the rasterized data (STEP S215). Transportation data that indicates the transportation speed of the recording medium is an example of the command data.

STEP S250: Clear Image Processing

Figure 12:
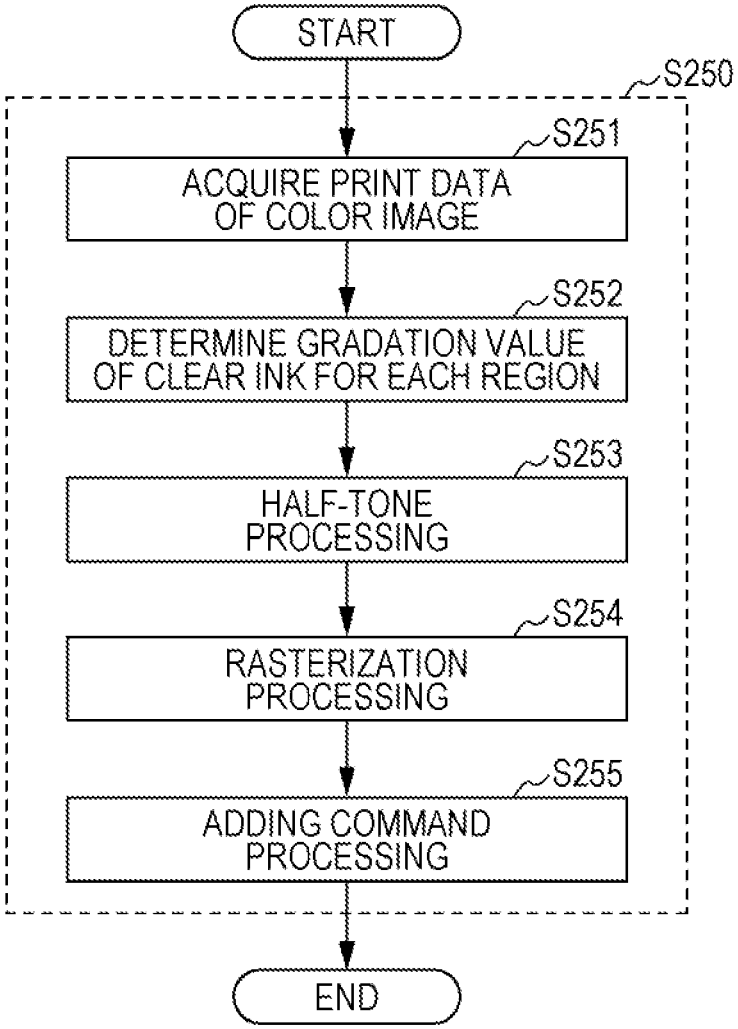
FIG. 12 is a flow chart of a processing flow performed by a printer driver in a clear image processing.

Subsequently, the clear image processing for discharging the clear ink which adjusts the glossiness of the image is performed. In FIG. 12, a flow chart of a processing performed by a printer driver in a clear image processing is illustrated.

First, the printer driver duplicates the color image print data which was color converted in the color image processing step (STEP S212), and acquires the duplicated color image print data as data for clear image processing (STEP S251). In the clear image processing, data for discharging the clear ink is generated based on the acquired data above.

Next, using the acquired color image data, the gradation value of the clear ink for each area (pixel) on which the image is formed is set (STEP S252). In other words, by setting the gradation value of the clear ink for each predetermined area in the image, the amount of the clear ink (clear DUTY) discharged on that area is defined. Here, for the sake of explanation, it is considered that the unit area is one pixel.

As described above, the color converted image data is 8 bit CMYK data indicated in 256 gradations of zero to 255 in each color for each pixel. The print driver selects a certain pixel A in the image, and calculates the color DUTY in the pixel A. The color DUTY is calculated from sum of the gradation values of four colors of CMYK. For example, in a case where the gradation value of K of the pixel A is 128, the gradation value of C is 64, the gradation value of M is 128, and the gradation value of Y is 64, then the color DUTY is calculated as (128+64+128+64)/(255+255+255+255)×100=37.6%.

Here, strictly speaking, the gradation value and the actual amount of ink discharge are different from each other. However, in view of the following point, the gradation value is intended to be treated in correspondence with the ink DUTY. That is, in the half-tone processing described above, the gradation value of 256 gradations for each color is converted into the gradation value of four gradations (or two gradations), the ink is discharged based on the data of four gradations. At that time, if the gradation value before the half-tone processing is large (for example, the gradation value is 255), the gradation value after the half-tone processing easily becomes large (for example, the gradation value is 3), thus, the amount of ink discharge is more likely to be large. Contrarily, if the gradation value before the half-tone processing is small (for example, the gradation value is 1), the gradation value after the half-tone processing easily becomes small (for example, the gradation value is 0), thus, the amount of ink discharge is more likely to be small. Therefore, the amount of color ink discharge per unit area (color DUTY) can be considered to be corresponding to the gradation value of 256 gradations.

Then, in the step of adding the gloss control table, the gloss control table of the new base material information BN550 corresponding to the new base material (recording medium) stored in the memory 63 is read out, and the clear DUTY in the pixel A is determined such that the glossiness becomes same to that set in the step of glossiness setting (STEP S200). In this way, the gradation value (amount of discharge) of the clear ink in the pixel A is determined.

Subsequently, similar to the case color image processing, the half-tone processing (STEP S253), the rasterization processing (STEP S254), and command addition processing (STEP S255) are performed, and the clear image processing ends.

STEP S280: Image Forming Processing

The discharge of each color ink is actually performed based on the print data of the color image and the clear image generated in each processing described above. That is, the color image is formed by discharging the color ink on the recording medium, corresponding to the print data of the color image. Then, by discharging the predetermined amount of clear ink for each unit area superposing on the color image based on the set clear DUTY, it is possible to print the image with desired glossiness or with the unevenness in glossiness be reduced.

Summary of First Embodiment

In the first embodiment, when adjusting the desired glossiness with respect to the image formed on the base material (new base material) of the new recording medium, the adjusting is possible by acquiring the pattern measured value of the new base material by implementing at least one printing of the test pattern, and then generating the new gloss control table corresponding to the new recording medium based on the relationship between the first gloss control table including the first pattern measured value of the first base material registered in the printing apparatus already and the second gloss control table including the second pattern measured value of the second base material.

Therefore, it is possible to form the image in which the unevenness of the glossiness is reduced and the image quality is excellent by performing the desired gloss control to the image formed with respect to the new recording medium, without performing a large number of test printing or measuring of test pattern using the color ink and the clear ink with respect to the base material (new base material) of the new recording medium as in the related art.

Second Embodiment

In the second embodiment, a first test image is printed using the gloss control table of the new base material, and a second test image is printed using the gloss control table selected by the comparison between the pattern measured value of the first test image and pattern measured value in the base material information already registered in the printer 1, and then by comparing the first test image and the second test image, the gloss control table in which the desired glossiness is included and the image quality is excellent is selected to be stored in associated to the new base material. That is, the printing method includes the step of adding the gloss control table as follows. The test printing forming the first test image is performed using the new gloss control table obtained in the gloss control table interpolation step in the first embodiment and the second test printing forming the second test image is performed using the gloss control table selected by comparing the known gloss control tables registered in the printer 1 and the first test image, and then by comparing the first test image and the second test image, finally, the gloss control table which can form the image closer to the image quality including the desired glossiness is discovered.

Moreover, in the step of adding the gloss control table in the second embodiment, the operation for obtaining the relationship between the color DUTY and the clear DUTY and the glossiness or the like are similar to those in the first embodiment, the description will be made as the relationships corresponding to those in FIG. 7 and FIG. 9 described above can also be obtained in the second embodiment. In addition, the configuration of the printer apparatus itself is also the same printer apparatus (printer 1) described in the first embodiment. Hereafter, the description will focus on the differences from the first embodiment.

Method of Adding Gloss Control Table in Second Embodiment

Figure 13:
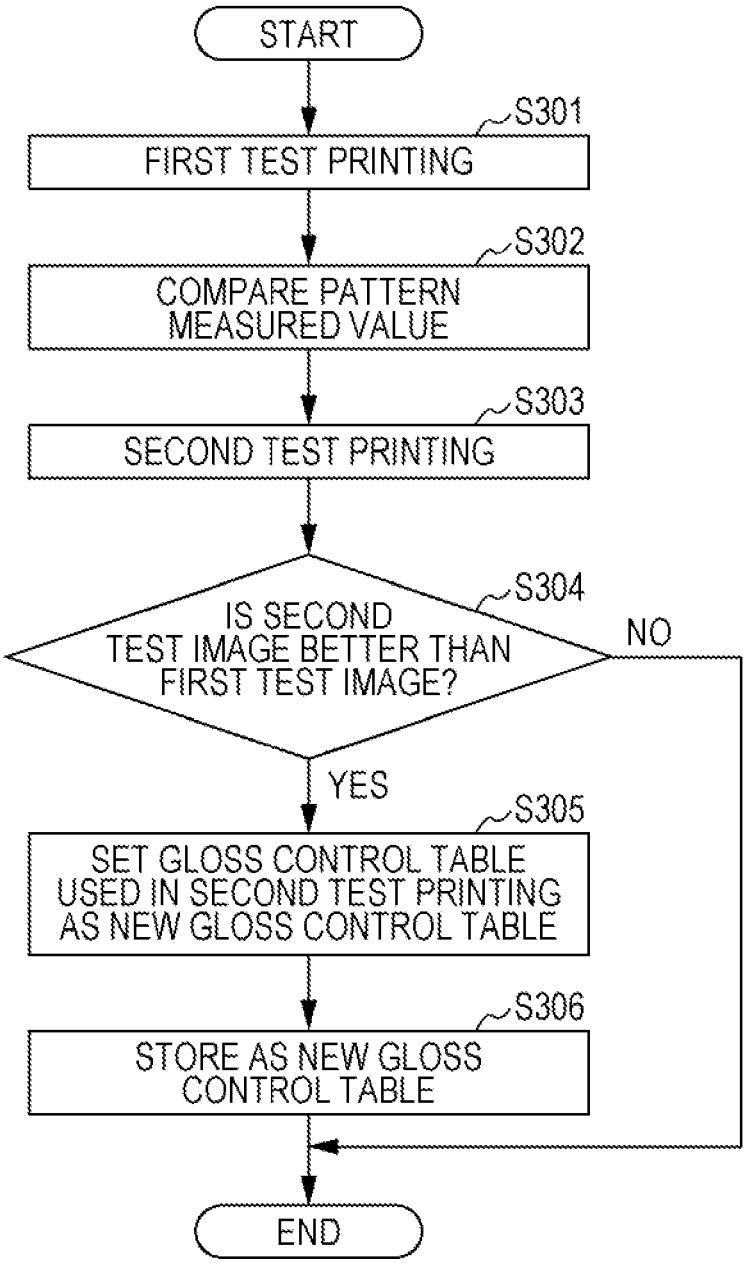
FIG. 13 is a flow chart illustrating a method of adding a gloss control table in the printing method in the second embodiment.

In FIG. 13, a flow chart indicating the method of adding a gloss control table in the printing method in the second embodiment is illustrated. The embodiment further has a step of test printing and a step of comparing the images formed in the step of test printing after storing (STEP S105 in FIG. 8) the new gloss control table created in the step of adding the gloss control table in the memory 63.

In the method of adding a gloss control table in the printing method in the second embodiment, using the new gloss control table obtained in the new gloss control table interpolation step and stored in the memory 63 as the storage unit (STEP S101 to STEP S105 in FIG. 8) in the method of adding a gloss control table in the first embodiment, the first test printing is performed (STEP S301), in which a predetermined test image is printed on the new base material to form the first test image.

Next, in STEP S302, the first pattern measured value of the first base material information B510 registered in the printer 1, the second pattern measured value of the second base material information B520, the third pattern measured value of the third base material information B530, and the pattern measurement value of the new base material are compared, the pattern measurement value that is closest to the pattern measurement value of the new base material is selected among the first pattern measured value, the second pattern measured value and the third pattern measured value. In FIG. 9, the pattern measurement value closest to line width 80 μm which is the pattern measurement value of the new base material is line width 70 μm which is the first pattern measured value of the first base material information B510.

Next, in STEP 303, the second test image is formed by implementing the step of the second test printing by which the predetermined test image is printed on the new base material using the gloss control table of the first base material information B510 stored in the memory 63 in associated with the first pattern measured value that is closest to the pattern measured value of the new base material obtained in the step of comparing the pattern measured values in STEP S302.

Next, in STEP S304, the first test image obtained in the step of first test printing in STEP S301 and the second test image obtained in the step of the second test printing in STEP S303 are compared with respect to the image quality including the desired glossiness.

In the step of comparing the test images, with respect to the desired image quality, in a case where the second test image is determined to be more excellent than the first test image formed using the new gloss control table obtained by the new gloss control table interpolation step described in the first embodiment and stored in the memory 63 (YES in STEP S304), instead of the gloss control table of the new base material stored in the step of recording the gloss control table in STEP S105 in the first embodiment, the gloss control table used in the step of the second test printing (the gloss control table of the first base material information B510 in the first embodiment) is set to be as the new gloss control table (STEP S305), and is stored in the memory 63 (STEP S306) in associated with the new base material, and then, is used as the gloss control table corresponding to the base material (new base material) of the new recording medium.

In the step of comparing the test images, in a case where the first test image is determined to be more excellent than the second test image (NO in STEP S304), the new gloss control table stored in the memory 63 in the step of adding the first gloss control table in STEP S105 is used in printing the image on the new base material as it is. Accordingly, the step of adding the gloss control table in the second embodiment ends.

According to the method of adding the gloss control table in the second embodiment, it is possible to generate the gloss control table by which the image closer to the desired glossiness can be formed in associated with the new base material, and to use in the method of image printing on the new base material (recording medium). Therefore, it is possible to effectively form the image with high quality closer to the desired quality including the glossiness.

In addition, in the method of adding the gloss control table in the second embodiment, the number of steps is increased more than in the first embodiment. However, it is possible to obtain the gloss control table that contributes to the printing of the image with the excellent quality such as the glossiness by the less number of test printing step than in the method of obtaining the gloss control table corresponding to the base material (new base material) of the new recording medium by performing a multiple number of test printing or test pattern measuring using the color ink and the clear ink in the related art.

Other Embodiment

The printer and the like are described as one embodiment, the above described embodiment is intended to facilitate the understanding of the invention, and is not intended to limit the invention. The invention can be modified and improved as long as there is no departure from the spirit thereof, and it is needless to say that the equivalents can be included in the invention. Particularly, the below described embodiment can also be included in the invention.

Regarding Printing Apparatus

In the embodiment described above, the printer was described as one of the examples of the printing apparatuses, but the invention is not limited thereto. For example, a technology similar to that of the embodiment may be adapted to various printing apparatuses in which the ink jet technology is applied such as: an apparatus for manufacturing a color filter, a dyeing apparatus, a micro-fabricated device, an apparatus for manufacturing semiconductors, a surface processing apparatus, a three-dimensional molding machine, a liquid vaporizer, an apparatus for manufacturing an organic EL (particularly, an apparatus for manufacturing a polymer EL), an apparatus for manufacturing a display, a deposition apparatus, an apparatus for manufacturing a DNA chip, or the like.

Regarding Ink Jet Printer

In the embodiment described above, the line head type printer in which the head is fixed was exemplarily described as the ink jet printer of the printing apparatus. However, a so-called serial printer in which the head is moved together with the carriage may be used.

Regarding Nozzle Array

In the embodiment described above, forming the image using four colors of KCMY ink and clear ink was exemplarily described. However, the invention is not limited thereto. For example, the image recording may be performed using the color ink other than KCMY and CL such as light cyan, light magenta, white, and the like.

In addition, the arraying order of the nozzle array in the head unit is also optional. For example, the order of the nozzle array K and C may be interchanged, and the configuration may be such that the number of nozzle arrays of K ink is more than the number of nozzle arrays of other color ink.

Regarding Piezo-Element

In each embodiment described above, the piezo-element was exemplified as the element which performs the operation for the ink to be discharged, but other element may also be used. For example, a heating element or an electrostatic actuator may be used.

The entire disclosure of Japanese Patent Application No. 2013-059562, filed Mar. 22, 2013 is expressly incorporated by reference herein.

What is claimed is:

1. A method of adding a gloss control table with respect to a new base material is added using a printing apparatus, the printing apparatus including a first discharge head that discharges a color ink;

a second discharge head that discharges a clear ink;

a storage unit that stores the gloss control table which defines a relationship between a color DUTY which is an amount of the color ink discharged per unit area of an image forming surface of a recording medium, a clear DUTY which is an amount of the clear ink discharged per unit area, and a glossiness of an image formed by the color ink and the clear ink discharged per unit area; and a control unit, and determining the clear DUTY in the unit area according to the color DUTY in the unit area of the image based on the gloss control table such that the glossiness of the formed image becomes a predetermined value, wherein, in the storage unit, first base material information formed from a first base material which is a base material of a first recording medium, first gloss control table which is the gloss control table with respect to the first base material, and a first pattern measured value which is a pattern measured value obtained from printing a test pattern using a predetermined amount of predetermined ink with respect to the first base material and measuring the test pattern, and second base material information formed from a second base material which is a base material of a second recording medium, second gloss control table which is the gloss control table with respect to the second base material, and a second pattern measured value which is a pattern measured value obtained from printing the test pattern using a predetermined amount of predetermined ink with respect to the second base material and measuring the test pattern being associated, are stored, the method comprising:

measuring the pattern of new base material for printing the test pattern using the predetermined amount of the predetermined ink of a new base material of a new recording medium on which the image is printed and for measuring the test pattern to measure the pattern measured value;

inputting the pattern measured value of the new base material to the printing apparatus;

interpolating the gloss control tables for obtaining a new gloss control table that is the gloss control table with respect to the new base material using a predetermined measured value interpolation method based on the first base material information and the second base material information in the control unit; and storing the new gloss control table for storing the new gloss control table obtained in the interpolating of the gloss control tables in the storage unit related to the new base material.

2. The method of adding the gloss control table according to claim 1, the method further comprising:

first test printing for printing a test image using the new gloss control table;

comparing the pattern measured value for comparing the first pattern measured value, second pattern measured value, and the pattern measured value of the new base material after the interpolating of the new gloss control table, and for obtaining the pattern measured value closer to the pattern measured value of the new base material among the first pattern measured value and the second pattern measured value;

second test printing for printing the test image using the gloss control table stored in the storage in associated with the pattern measured value which is closer to the pattern measured value of the new base material obtained in the comparing of the pattern measured value; and comparing test image for comparing the first test image that is the test image obtained in the first test printing and the second test image that is the test image obtained in the second test printing with respect to an image quality including the desired glossiness, wherein, in a case where the second test image is determined to be excellent in the comparing of the test image, the gloss control table used in the printing of the second test image is stored in the storage unit in associated with the new base material, instead of the gloss control table of the new base material in the storing of the gloss control table.

3. The method of adding the gloss control table according to claim 1, wherein the color ink and the clear ink are the photocurable ink that are cured by irradiation of light.

* * * * *